US009882276B1

(12) United States Patent
Hall et al.

(10) Patent No.: US 9,882,276 B1
(45) Date of Patent: Jan. 30, 2018

(54) PIVOTING SENSOR DRIVE SYSTEM AND METHOD

(71) Applicant: Lockheed Martin Corporation, Bethesda, MD (US)

(72) Inventors: Richard R. Hall, Baldwinsville, NY (US); Peter M. Nichols, Johnson City, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 116 days.

(21) Appl. No.: 14/695,586

(22) Filed: Apr. 24, 2015

Related U.S. Application Data

(62) Division of application No. 13/205,261, filed on Aug. 8, 2011, now Pat. No. 9,263,797.

(51) Int. Cl.
*H01Q 3/00* (2006.01)
*H01Q 3/08* (2006.01)
*H01Q 1/12* (2006.01)

(52) U.S. Cl.
CPC ..... *H01Q 3/08* (2013.01); *H01Q 1/12* (2013.01)

(58) Field of Classification Search
CPC .. H01Q 3/00; H01Q 3/02; H01Q 3/08; H01Q 1/12
USPC ..... 343/757, 758, 765, 766, 882
See application file for complete search history.

(56) References Cited

U.S. PATENT DOCUMENTS

| | | | |
|---|---|---|---|
| 4,378,709 | A | 4/1983 | Chitayat |
| 4,490,724 | A | 12/1984 | Bickman |
| 5,419,521 | A | 3/1995 | Matthews |
| 6,034,643 | A | 3/2000 | Nishikawa et al. |
| 6,111,542 | A | 8/2000 | Day et al. |
| 6,218,999 | B1 | 4/2001 | Bousquet et al. |
| 6,404,385 | B1 | 6/2002 | Croq et al. |
| 6,407,714 | B1 | 6/2002 | Butler et al. |
| 6,486,845 | B2 | 11/2002 | Ogawa et al. |
| 6,512,490 | B1 | 1/2003 | Lee |
| 6,812,904 | B2 | 11/2004 | Tietjen |
| 7,969,375 | B2 | 6/2011 | Blalock |
| 2009/0315795 | A1 | 12/2009 | Blalock |
| 2010/0092179 | A1 | 4/2010 | Bunch et al. |
| 2010/0245196 | A1 | 9/2010 | Miron |

*Primary Examiner* — Dieu H Duong
(74) *Attorney, Agent, or Firm* — Howard IP Law Group

(57) ABSTRACT

A method of articulating a sensor comprising the steps applying a friction force on a curved surface of a sensor support frame with a friction drive actuator for pivoting the sensor support frame about a pivot point for altering an elevation and azimuth angle of the sensor. The sensor may be maintained at a predetermined elevation angle while the sensor support frame is pivoted about the pivot point with the friction drive actuator for altering an azimuth angle of the sensor.

12 Claims, 7 Drawing Sheets

PIVOTING SENSOR DRIVE SYSTEM AND METHOD

CROSS-REFERENCE TO RELATED APPLICATIONS

This application is a divisional application of co-pending U.S. patent application Ser. No. 13/205,261, entitled PIVOTING SENSOR DRIVE SYSTEM, filed Aug. 8, 2011, the entire contents of which is herein incorporated by reference for all purposes.

FIELD OF THE INVENTION

The present invention relates generally to articulating sensors, and more specifically, to scanning antenna systems and methods of operating the same.

BACKGROUND

Antennas and other sensors, such as RF beam scanning arrays used in radar systems, typically utilize a large area antenna array mounted on a rotating platform to revolve the antenna in the azimuth direction. These rotatable platforms allow the array to be oriented at a particular azimuth angle, or to sweep through an entire range of azimuth angles at a predetermined angular rate. In traditional rotating radar systems, one end of the array is pivotally mounted to the rotating platform, forming a cantilevered arrangement in which the array can be tilted to a desired elevation angle by, for example, a hydraulic linear actuator. In this cantilevered configuration, the array often has a center of mass offset vertically and/or horizontally from the center of the rotating platform.

These systems suffer significant drawbacks resulting from their use of traditional rotational motion (i.e. fixing a desired angle of elevation and rotating the array around a single axis) to sweep the array through a range of azimuth angles. Such problems include primary support bearing failures, power limitations and reduced reliability resulting from the use of slip-rings and rotary fluid joints, as well as the need for heavy, complex leveling sub-systems. Further, rotated antenna arrays typically suffer from a cylindrical "dead-zone" generally oriented directly above the rotating array and in which coverage by the scanning antenna array cannot be achieved.

Alternative systems and methods are desired.

SUMMARY

In one embodiment of the present disclosure, a system includes a sensor mounted to a pivoting support frame, such as a structural sphere. The support frame is configured to be pivoted about at least two axes with respect to a common pivot point. At least one actuator, such as a friction drive, is configured to alter both the elevation and azimuth angle of the sensor by pivoting the sensor about the pivot point. The frame may be metallic and configured to conduct at least one of power and electrical signals from external sources to the sensor via the at least one actuator or a frame support.

Another embodiment of the present disclosure includes a method of articulating a sensor. The method comprises the steps of applying a first force on a first surface of a sensor support frame supporting a sensor with a first friction drive actuator for pivoting the sensor support frame about a first axis and a pivot point. A second force is applied on a second surface of the sensor support frame with a second friction drive actuator for pivoting the sensor support frame about a second axis and the pivot point. The pivot point is defined at an intersection of the first axis and the second axis. Pivoting the sensor support frame about the first and second axes provides the sensor with 360 degrees of azimuth revolution at a plurality of elevation angles.

In another embodiment, a method of articulating a sensor includes applying a force on a three-dimensional curved surface having a constant radius of a sensor support frame with a friction drive actuator. The force is operative to pivot the sensor support frame about a common pivot point defined at an intersection of at least two axes. The sensor is maintained at a predetermined elevation angle while the sensor support frame is pivoted about the pivot point to alter an azimuth position of the sensor with the friction drive actuator.

In another embodiment, a method of articulating a sensor comprises the step of pivoting a sensor support frame about at least two axes and a common pivot point for altering an elevation and azimuth angle of the sensor. The sensor support frame is pivoted by applying friction force on a surface thereof with a friction drive actuator. The sensor is maintained at a predetermined elevation angle while the sensor support frame is pivoted about the at least two axes and the pivot point with the friction drive actuator for altering an azimuth angle of the sensor.

In one aspect of the present disclosure, a system includes an arrangement that does not require separate sub-systems for leveling the system's base, tilting, and/or rotating the sensor.

DETAILED DESCRIPTION

Figure 1:
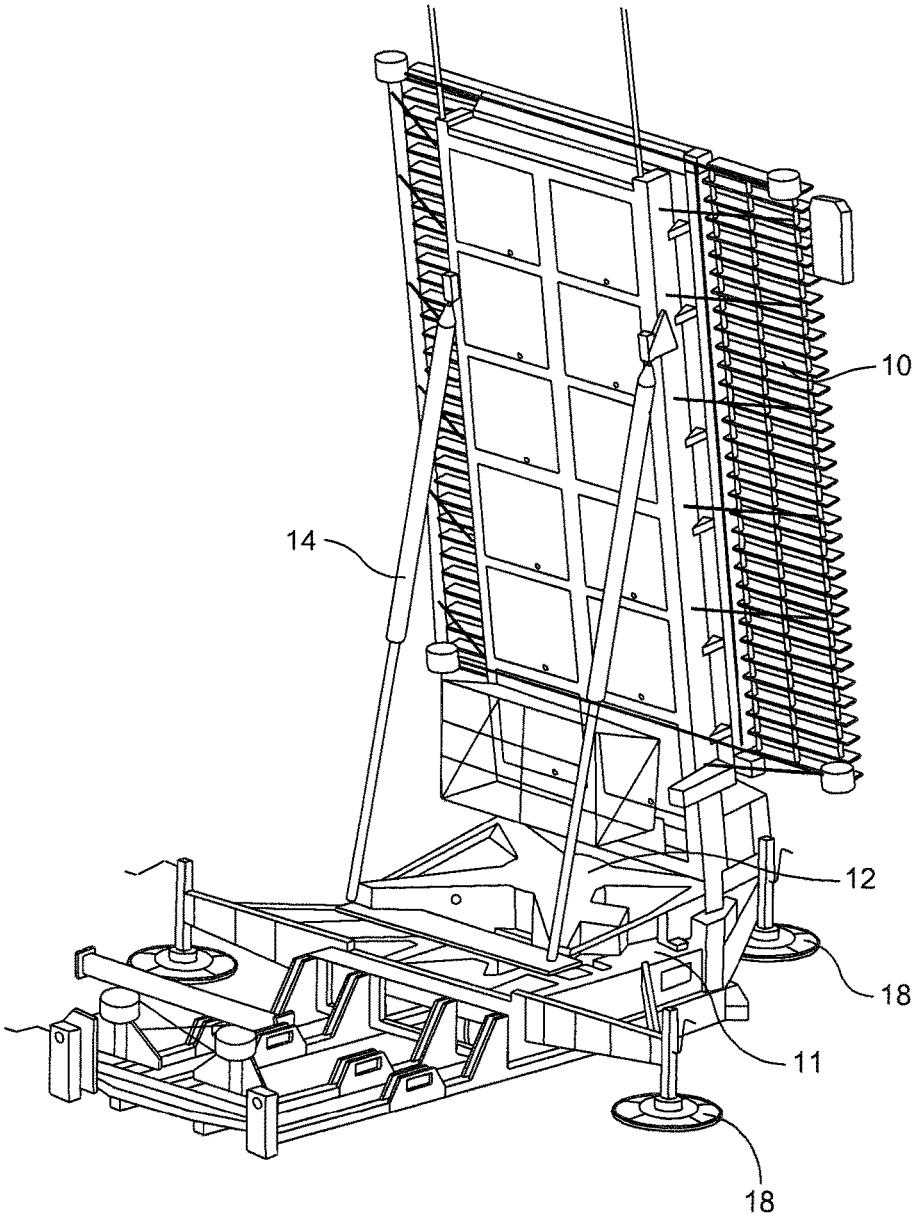
FIG. 1 (PRIOR ART)
FIG. 1 is a perspective view of an exemplary radar installation according to the prior art.

It is to be understood that the figures and descriptions of the present invention have been simplified to illustrate elements that are relevant for a clear understanding of the present invention, while eliminating, for purposes of clarity, many other elements found in articulating sensors, such as antennas used in scanning radar systems. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

As described above, and referring generally to FIG. 1, traditional radar systems utilize a large scanning antenna array 10 mounted on a rotating platform 12 used to revolve array 10 with respect to a stationary base 11. Platform 12 allows array 10 to be oriented at a particular azimuth angle, or to sweep the array through an entire range of azimuth angles at a predetermined angular rate. One end of array 10 is pivotally mounted to rotating platform 12, forming a cantilevered arrangement in which the array can be tilted to a targeted elevation angle by, for example, at least one hydraulic linear actuator 14. Platform 12 is traditionally rotated with respect to base 11 via various gear-driven arrangements, which include rolling element bearings for supporting the platform on the base. Base 11 is supported with respect to the ground by, for example, outriggers 18. These outriggers are often adjustable, and used to level base 11 when positioned on an uneven and/or unlevel surface.

As discussed, conventional systems are limited in both functionality and reliability. For example, traditional array rotation creates a virtual dead-zone directly above the array where scanning coverage cannot be achieved. Further, the hydraulic actuator(s) and pivoting arrangements used to set the elevation angle can create inaccuracies in the positioning of the antenna array, introducing pointing errors.

Regarding system reliability, conventional cantilevered large-area array systems are subject to significant forces placed on the bearings, outriggers and tie-downs, support and articulation assembles, as well as the radar face itself. In addition to creating problems securing the radar assemblies to a surface (e.g. ground), these added stresses may lead to premature failure of the components. For example, the main support bearings of the rotatable platforms are subject to significant loads from the weight of the cantilevered antenna arrays, as well as the large forces acting thereon at least in part due to dynamic imbalances and environmental forces (e.g. wind/ice/snow) acting on the exposed surfaces of the antenna array due to above-described offset of the center of mass. These forces can result in fatigue and eventual failure of the bearings and other driveline components. Further, array deflection may reduce system performance by introducing additional pointing error.

The rotational motion of the antenna array necessitates the use of components such as slip-rings for providing the array with power, as well as rotary fluid joints for providing liquid coolant. In addition to raising reliability issues, slip-rings impose significant power limitations on the system. Likewise, rotary fluid joints are prone to leaking. These arrays also typically require long cooling paths, thereby creating cooling challenges.

Further still, positioning these rotating arrangements on an uneven and/or unlevel surface necessitates additional systems to level the base, increases setup (and teardown) time and reduces operating time. Furthermore, radar base leveling is relatively complicated and difficult to perfect. In the case of a mobile radar system mounted to a vehicle, the vehicle is often fitted with heavy and expensive outriggers and actuators to provide this leveling function.

Embodiments of the present invention may improve upon these shortcomings by providing a system (e.g. a radar antenna system) which does not utilize traditional rotating motion to alter the azimuth position of a sensor (e.g. an antenna array). Furthermore, embodiments of the present invention may provide a system which does not cantilever the sensor to alter its elevation angle. In one embodiment, a system is provided comprising a sensor mounted to a support frame, for example, a structural sphere. The frame is pivotally mounted to a base such that at least one actuator may be provided for pivoting the assembly into a plurality of azimuth and elevation angles with respect to the base. The at least one actuator may comprise, for example, one or more friction drives configured to apply a drive force on a surface of the frame, pivoting the sensor to virtually any azimuth and elevation angle. In one embodiment, the actuators and/or other support members may also be used to transfer power and signals from external sources to the sensor.

As a result of the non-traditional motion of the system, many of the above-described drawbacks the prior art are eliminated. For example, power, fiber optic and cooling connections may be fed to the sensor by conduits extending through the center of the non-rotating frame, eliminating the need for rotatable connections such as slip rings and rotating fluid joints. The pivoting motion of the system can also be altered in real-time in order to correct for any leveling or positioning deficiencies, eliminating the need for a separate base leveling system, as well as reducing the pointing error of the system. Further still, full hemispherical coverage may be achieved through sensor scanning operations.

Figure 2A:
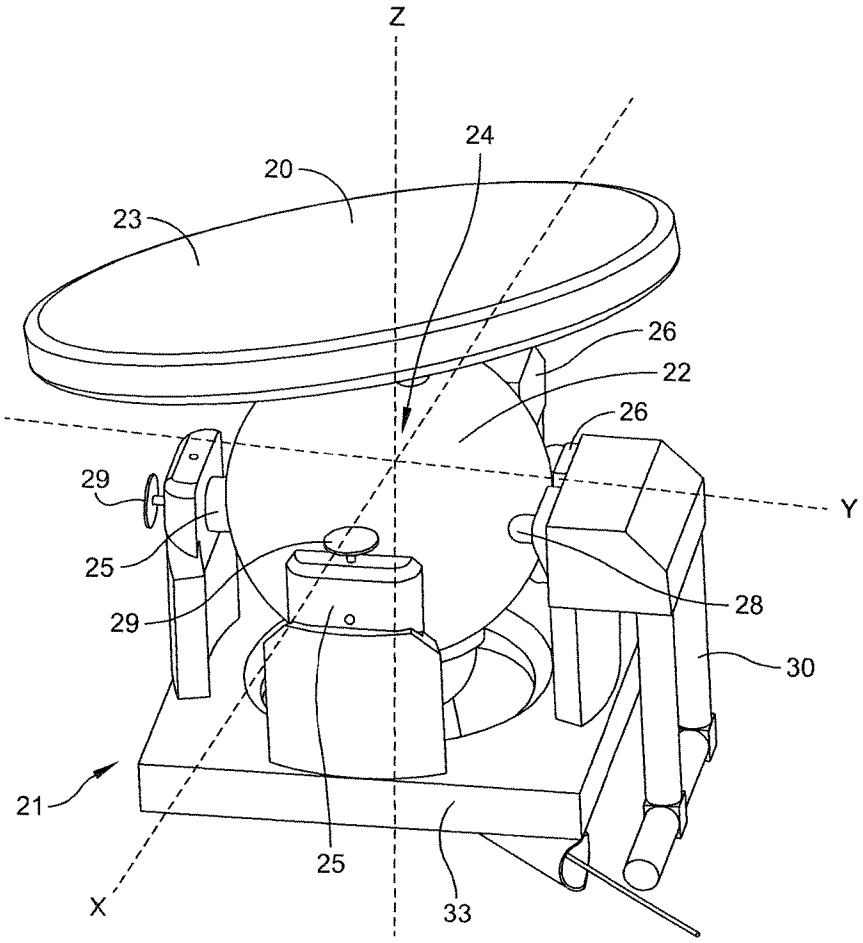
FIGS. 2A and 2B are perspective views of a system according to an embodiment of the present invention.
Figure 2B:
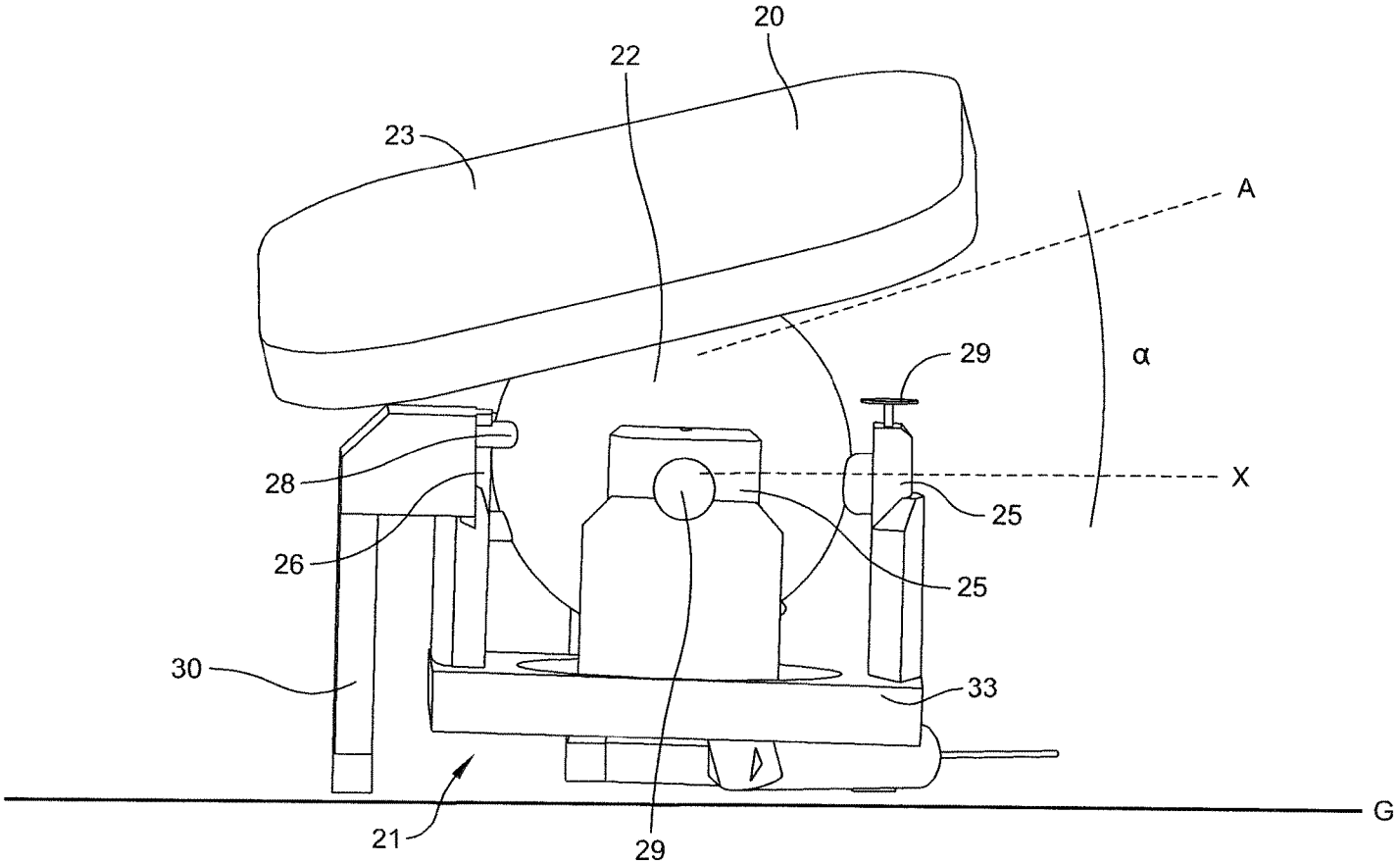

Referring generally to FIGS. 2A and 2B, an exemplary sensor drive system according to an embodiment of the present invention is shown. The system includes a sensor, by way of example only, antenna array 20 having a plurality of antenna elements mounted on its outer face 23 for transmitting and/or receiving radar data. The antenna array of FIG. 2A is shown as a substantially planar array, but may include other configurations as is understood by one of ordinary skill in the art. Array 20 is mounted on its underside and generally at its center to a pivoting array support frame 22. In the illustrated embodiment, frame 22 comprises a generally spherical structure rotatably supported by a base assembly 21. Frame 22 may be at least partially hollow, allowing for the routing of power, control, and cooling lines therethrough. Frame 22 may be supported by base 21 such that pivoting around at least two axes (x,y), and up to three-axes (x,y,z), with respect to base assembly 21 is possible (i.e. frame 22 may pivot and/or rotate about its center 24, or pivot point, with respect to base 21). In this way, three-hundred and sixty degrees (360°) of azimuth coverage is achievable at a wide range of elevation angles. In one embodiment, the elevation and azimuth angles of antenna array are sufficiently variable so as to cover a full hemispherical space above the site, eliminating the cylindrical "dead-zone" often created by traditional rotating antennas.

Referring generally to FIG. 2B, during a traditional scanning operation, array 20 may be supported and maintained in a tilted position, so that the plane "A" formed by array 20 is maintained at a constant tilt or elevation angle α with respect to a horizontal plane "X" formed generally parallel to base 21, or to ground (G). The pivoting arrangement also provides array 20 with 360° of azimuth revolution. Specifically, the outer face 23 of array 20 can be oriented at various azimuth angles over a 360° range with respect to base 21 or ground (G). The highly pivotal nature of the embodiments allow for a wide range of positioning options for the radar system in the field. For example, in the case of a mobile radar arrangement mounted to a vehicle, the radar may still achieve a constant desired tilt angle α with respect to the ground despite the vehicle being positioned on an uneven or unlevel road or hillside. It should also be noted that because the sensor of each of the above-described embodiments is supported near its center of mass, the arrangement provides an inherently balanced design, thereby reducing or eliminating many of the problems associated with traditional cantilevered sensors and their dynamic imbalances.

In one embodiment, frame 22 is supported on base assembly 21 by at least one support, such as a bearing assembly, while the elevation and azimuth angles may be controlled by at least one drive assembly, such as a friction drive, arranged on base assembly 21. In the exemplary embodiment, base assembly 21 includes two bearing assemblies 26 for supporting frame 22, and two drive assemblies 25 for altering its position.

Bearing assemblies 26 may include a plurality of bushings or bearings 28, such as ball bearings, and are configured to support and/or secure frame 22 with respect to base 21. In one exemplary configuration, bearings 28 are resiliently mounted, such that they may apply a force on frame 22 in a direction toward an opposing respective drive assembly 25. More specifically, in the embodiments of FIGS. 2A, 2B and 3A, each bearing assembly 26 is arranged opposite a corresponding one of two drive assemblies 25 on base assembly 21. Each bearing assembly 26 is operative to provide a preload force in the direction normal to, for example, the contacting surface of a friction drive of assembly 25. Thus, bearing assemblies 26 ensure proper support and positioning of frame 22, and provide sufficient friction for proper functioning of drive assemblies 25. In the exemplary embodiment of FIGS. 2A, 2B and 3A, three bearings 28 are provided on each assembly 26. These bearings are spaced optimally to capture and position spherical frame 22. In one embodiment, bearings 28 of each assembly 26 are arranged on either side of imaginary planes bisecting frame 22 along horizontal and vertical axes, forming a generally triangular arrangement which captures frame 22 against friction drive assemblies 25.

Figure 3A:
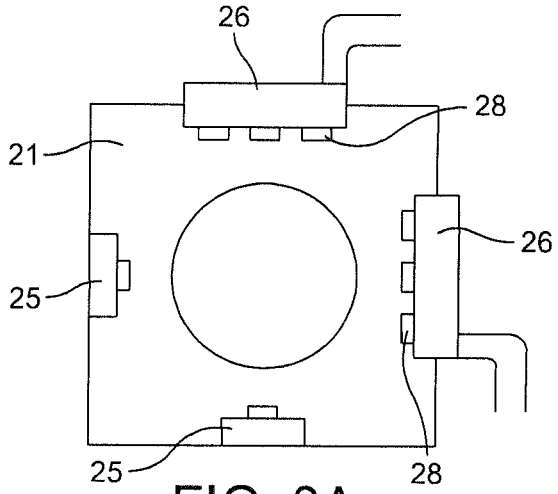
FIGS. 3A to 3C are overhead views of various base and support arrangements according to embodiments of the present invention.
Figure 3B:
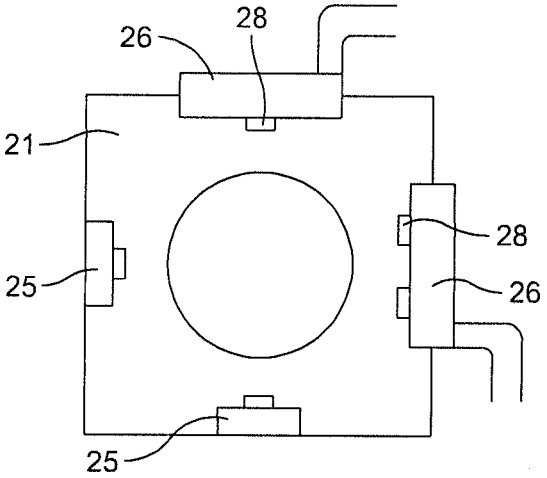
Figure 3C:
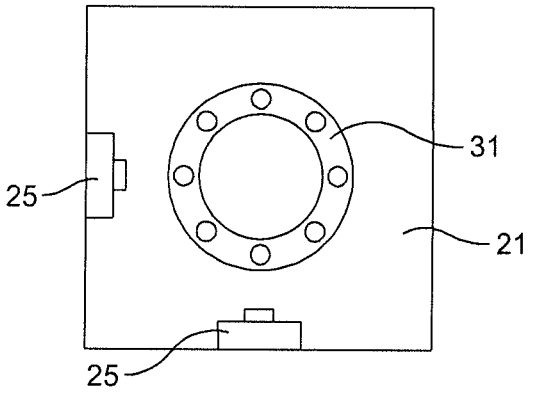

While FIGS. 2A, 2B and 3A show a system having two bearing assemblies 26, each with three bearings 28 supporting frame 22, it should be understood that alternate embodiments may be utilized without departing from the scope of the present invention. For example, more or less than three bearings may be provided, on any number of supports. FIG. 3B illustrates an exemplary configuration wherein two bearing assemblies 26 are provided, each comprising two bearings 28. One assembly 26 comprises bearings 28 aligned generally on a horizontal axis with respect to base 21, while the remaining assembly 26 comprises bearings 28 aligned generally on a vertical axis, securely capturing frame 22 between assemblies 26 and friction drive assemblies 25. Moreover, while the embodiments of FIGS. 2A, 2B, 3A and 3B comprise bearing assemblies 26 which extend vertically with respect to base 21, and support frame 22 on respective sides thereof, alternate embodiments may implement other arrangements. For example, FIG. 3C shows a system configured to rotatably support a pivoting frame from a bottom side thereof, proximate the base. In this embodiment, one or more bearings, such as a roller bearing 31, may be arranged on base 21, and configured to rotatably support the pivoting frame. This arrangement may be used to support a spherical frame, such as that set forth in FIGS. 2A, 2B and 4, as well as frames having alternate shapes and configurations. See, for example, FIG. 6A. In the exemplary embodiment, drive assemblies 25 may be arranged as previously described, or arranged in any other suitable manner for pivoting the frame with respect to the base.

Still referring to FIGS. 2A-3C, drive assemblies 25 may include, by way of non-limiting example only, electric, pneumatic or hydraulic rotary actuators, lead-screw actuators, spherical motors, or stepper-motors. In one embodiment, electric actuators may be preferred for their relative accuracy and ease of integration into a control system. The actuators may be fitted with a friction-generating surface, such as a roller, configured to contact an outer surface of frame 22. In one embodiment, drive assemblies 25 may be resiliently mounted (and/or the rollers attached thereto inherently resilient or resiliently mounted) and configured to generate a force normal to the surface of frame 22 to ensure generation of suitable friction therebetween. The roller may comprise a material suitable for providing both the generation of sufficient friction between itself and the frame, as well as allowing for slip between the roller and frame 22, if so required for proper pivoting of the array. Exemplary roller materials may include, but are not limited to, metallic, semi-metallic, aramid, ceramic, organic or plastic materials. Drive assemblies 25 may further comprise positional feedback sensors, by way of example only, encoders 29 operative to monitor the position (or displacement) of the actuators, and thus the position of the array. The output of encoders 29 may be provided to a control system described below with respect to FIG. 8. Positional feedback may be accomplished by, for example, optical, mechanical, electrical or electromagnetic devices used to monitor at least one of the real-time position or displacement of the actuators, the position of a reference point on a surface of the frame 22, and the position of the array.

The friction drive assemblies may be used to pivot the sensor in any number of ways. In one embodiment, for example, each drive assembly may provide a force in a single direction relative to the surface of the frame support for pivoting the frame support around a single axis. For example, one drive may apply a force in a vertical direction, and a second in a horizontal direction for creating rotational forces around the x or y and z axes. In another embodiment, both drives may apply a force in the same direction (e.g. both in the vertical direction for rotation around the x and y axis). In yet another embodiment, each drive assembly may contain more than one actuator, or a multi-axis actuator (e.g. a spherical motor), such that an individual drive assembly can impart force in multiple directions.

Figure 4:
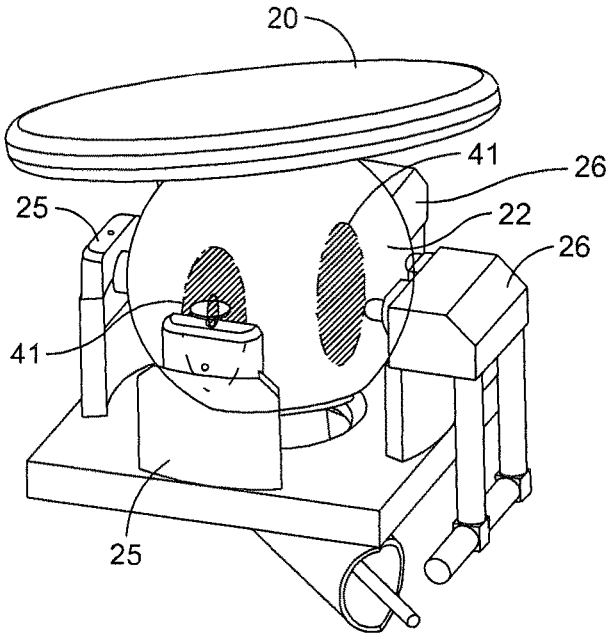
FIG. 4 is an outline perspective view of the system of FIGS. 2A and 2B.

Referring generally to FIG. 4, in one embodiment of the present invention, exemplary drive paths 41 are shown (in shadow), representing one orbital path of spherical frame 22 with respect to the actuators and/or bearing assemblies for achieving a full 360° azimuth sweep at a given angle of elevation. These orbital paths 41 may be altered by, for example, an actuator control system (FIG. 8) to operate the array in any number of modes (e.g. scanning, stationary, etc.). These paths may also be altered in real-time, to correct for, for example, temperature or thermal effects, wind/weather loads, and other environmental conditions, decreasing pointing error, and/or to level the sensor with respect to the horizon.

Figure 5:
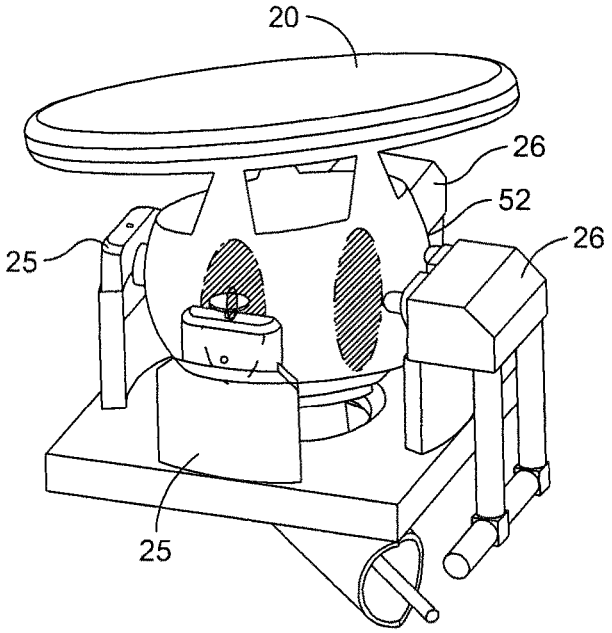
FIG. 5 is an outline perspective view of a system according to an embodiment of the present invention.

FIGS. 5-7B illustrate several alternate embodiments of the frame and frame supports. More specifically, while the previous embodiments included a structural sphere used to support and articulate the sensor, it should be understood that pivoting systems according to embodiments of the present invention are not limited to spherical frames, or semi-spherical frames. For example, FIG. 5 shows an embodiment wherein a ring-like support frame 52 is arranged between drive and support assemblies as described above with respect to the embodiment of FIGS. 2A and 2B. In one embodiment, frame 52 is at least partially hollow, allowing for the routing of power, control, and cooling lines therethrough. A sensor 20 may be attached to this frame which operates in substantially the same manner as described above. More specifically, frame 52 may be held against friction drive assemblies by one or more bearing arrangements. Exemplary orbital motion paths of these drive assemblies are shown on a contact surface of frame 52. In the described embodiments, it should be understood that these surfaces may comprise a curvature in order to facilitate pivoting the frame using a fixed friction drive. In some embodiments, surfaces having a constant-radius of curvature may be implemented. In yet other embodiments, drive assemblies may be moveably arranged with respect to the contact surface (i.e. moveable perpendicularly with respect to the surface), facilitating the use of, for example, straight contact surfaces (i.e. free from curves).

Figure 7A:
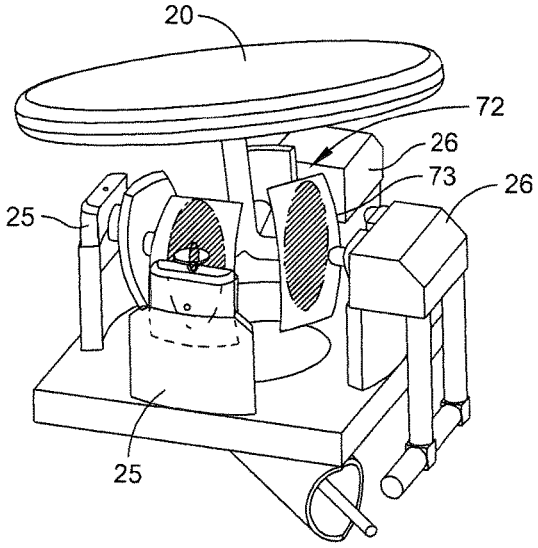
FIGS. 7A and 7B are perspective and overhead views respectively of a system according to an embodiment of the present invention.
Figure 7B:
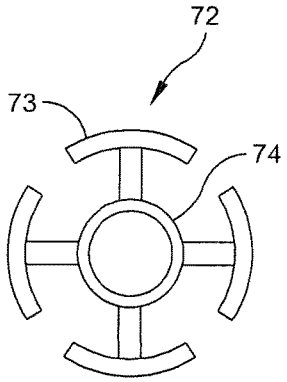

Similarly, the embodiment of FIGS. 7A and 7B may utilize both the bearing supports and drive assemblies described above with respect to FIGS. 2A and 2B used to articulate a rotor arrangement 72 configured to support a sensor. Rotor 72 may comprise, for example, four panels or contact surfaces 73 on which rotor 72 and the sensor are supported and/or rotated by the above-described bearing and drive assemblies. As set forth above, in one embodiment, at least a portion of each contact surface 73 may be curved, more specifically, curved with a constant radius (i.e. to resemble a segment of an external surface of a sphere). Rotor 72 may comprise a hollow center portion 74 for routing power, control and cooling lines to the sensor.

Figure 6A:
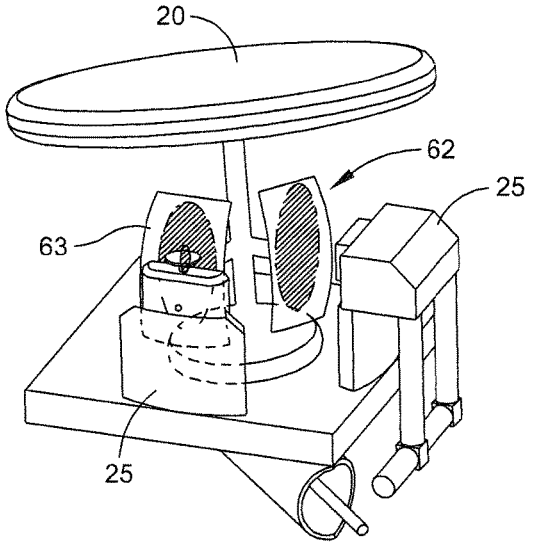
FIGS. 6A and 6B are perspective and overhead views respectively of a system according to an embodiment of the present invention.
Figure 6B:
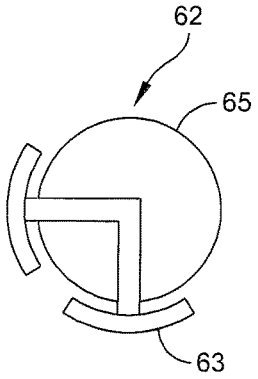

FIGS. 6A and 6B are directed to an embodiment of the present invention utilizing, for example, a frame 62 rotatably supported on a bottom portion 65 thereof, by, for example, the bearing arrangement of FIG. 3C. At least one friction or contact surface 63 may be provided for contact with at least one drive assembly used to articulate frame 62 and an attached sensor. Surface 63 may also comprise a curved panel. In the illustrated embodiment, two surfaces 63 are provided for contacting two corresponding drive assemblies. Because frame 62 is supported proximate the base, bearing assemblies as set forth above with respect to FIGS. 2A-3A, 4-5, 7A and 7B may not be used.

The ability to route all connection hardware, such as wiring, fiber optics, pneumatic or hydraulic lines, and coolant piping through the interior, or proximate the center of the frames according to embodiments of the present invention may be advantageous. In addition to simplifying routing, this arrangement centralizes critical systems, and improves balance by centralizing weight. As described above, because the sensor of the present invention is not utilizing traditional rotational motion (i.e. fixing a desired angle of elevation and rotating the sensor 360° around a single axis), the wires, piping, and associated connections may only have to be fitted with conventional strain relief to withstand the pivoting of the sensor, rather than more expensive and unreliable couplers such as slip rings and rotary fluid joints.

While embodiments of the present invention generally describe power and control connections to the sensor being made through wire and/or fiber optic connections routed through the pivoting frame, alternate embodiments of the present invention may utilize the drive assemblies, actuators, frame support members, or other conductive components to transfer power and/or control signals from external sources, through the outer surface of the pivoting frame, to the sensor. More specifically, and referring generally to FIGS. 2A and 2B, conduits 30 may be provided for feeding power and/or signal to any desired portion of bearing assemblies 26, drive assemblies 25, or other conductive followers configured to transmit signals through the outer surface of frame 22. By transmitting signals through frame 22 via the support and/or drive arrangements, routing of power and control lines through the pivoting frame may be reduced or eliminated entirely. Accordingly, reliability concerns due to, for example, strain and/or fatigue of the moving wire and/or fiber optic connections may be reduced or eliminated. In these embodiments, at least a portion of the outer surface of frame 22 and the corresponding drive/support assemblies may comprise conductive materials suitable for achieving and maintaining electrical connection while frame 22 is pivoted with respect to base 21.

With respect to any of the above-described embodiments, all or part of the support frame and/or the contact surfaces thereof may be comprised of corrosion-resistant materials, or may have corrosion-resistant coatings applied thereon, to reduce the effects of exposure to the operating environment over extended periods of time. Moreover, additional features, such as surface wipers and heating elements, may be fitted to the drive and/or support assemblies to maintain a sufficiently clean contact surface during operation, including preventing the buildup of, for example, dirt, ice or other precipitation.

The sensor of any of the above-described embodiments may be supported on a telescoping or otherwise extendable frame moveable between a first retracted position, a second extended position, and any intermediate position therebetween. For example, a center portion 74 of the frame or rotor of FIGS. 7A and 7B may comprise a telescoping support. This extendable frame may be pivoted as described above, to maintain the ability to alter both elevation and azimuth angles. This arrangement provides for both compact positioning of the sensor during storage or transportation, as well as improved articulation capabilities of the sensor when in an extended position (i.e. increased elevation angles may be realized by extending the frame vertically with respect to the base). The frame may be electrically, pneumatically, or hydraulically powered, or may comprise a manual lifting and retracting arrangement.

In another embodiment telescoping counterbalances may be provided and arranged between the base and the sensor. The counterbalances are configured to provide additional support to the sensor, by, for example, counteracting forces placed on the surfaces of the sensor by loads generated by environmental forces (e.g. wind/ice/snow), as well as any dynamic imbalances caused by the articulation of the sensor. In this way, the counterbalances can be used to alter the stiffness of the sensor, adjusting its natural frequency, thus allowing the system to compensate for a variety of operating conditions and desired operating parameters. The counterbalances may be most effectively arranged proximal to the outer edges of the sensor, supporting the portions of the sensor likely to experience the most deflection. However, the counterbalances may be placed anywhere support is deemed most effective, and/or dictated by packaging constraints. The counterbalances may comprise linear actuators, but may also comprise dampeners, springs, or other suitable components, with or without telescoping ability. In an alternative arrangement, the counterbalances may be utilized to provided additional motion control, for example, dampening the motion of the sensor as it is pivoted. This may be particularly important during high-speed sweeps of the sensor, wherein the forces generated in the sensor due to quickened acceleration and deceleration of the sensor are greater. In either configuration, the use of counterbalances provides for the active dynamic adjustment of the sensor, providing significant tuneability and stability control over the arrangements of the prior art.

Figure 8:
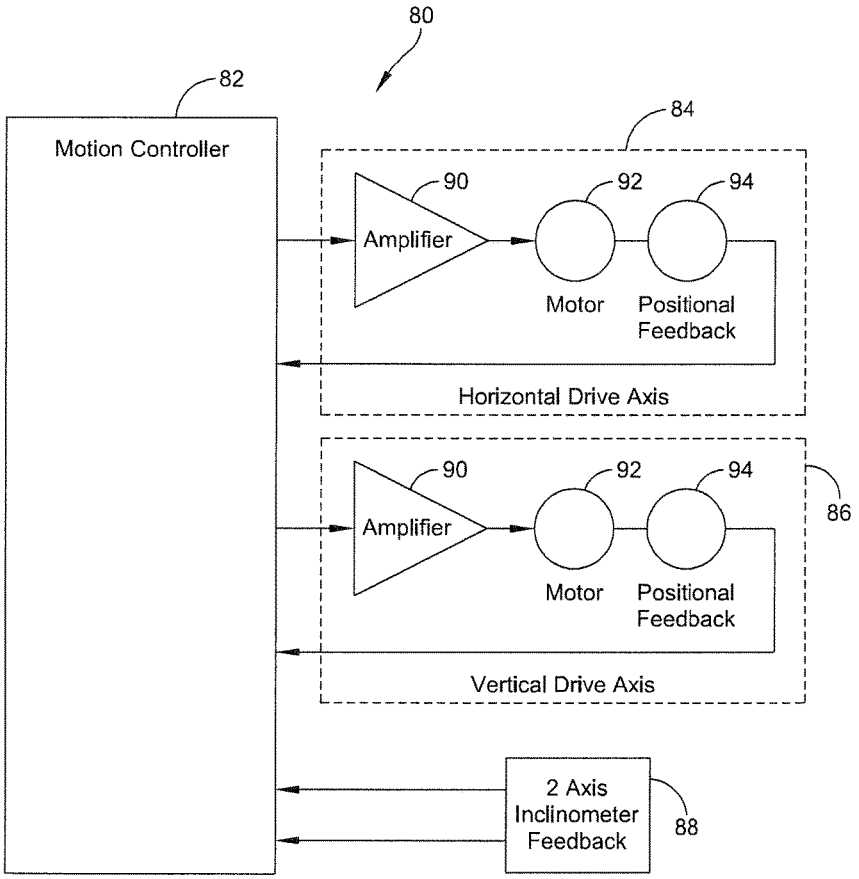
FIG. 8 is a block diagram of an exemplary system useful for controlling embodiments of the present invention.

In any of the above-described embodiments, a control system may be provided for altering the position of the sensor mounted onto the drive system (e.g. an antenna array). The control system may utilize, for example, an array mapping routine to correlate the sensor's rotational orientation to the system's reference coordinate system. Referring generally to FIG. 8, an exemplary system 80 useful for controlling a drive system according to embodiments of the present invention is shown. System 80 includes, for example, a motion controller 82, which may comprise one or more microprocessors, data storage devices, and interface hardware, operative to selectively control the operation of the one or more actuators. In the illustrated system, two control channels 84,86 are shown, one operating a drive 92 for pivoting around a generally horizontal axis, the second a drive for pivoting around a vertical axis. While two actuators or control channels are shown, any number of actuators may be used to control the pivoting frame according to embodiments of the present invention. Moreover, as set forth above, actuators may operate in any number of directions to achieve the pivoting motion. For example, two actuators, each having a horizontal drive axis, may be used to achieve the pivoting motion. Each control channel 84, 86 may comprise, for example, an amplifier 90 operative to boost a control signal provided by controller 82 for powering each motor or actuator 92.

In the exemplary embodiment, each channel 84,86 features a feedback system comprising, for example, a position sensor in communication with motion controller 82. Position sensor 94 may comprise an encoder or optical sensor operative to measure, for example, the displacement (e.g. rotation) of each of the actuators during use. In other embodiments, position sensors 94 may be implemented in other configurations, such as, for example, part of an optical sensing system used to determine the position of the antenna array, or the position of actuator relative to the surface of the array. In particular, the real-time array position monitoring and feedback may be achieved using other means in addition to, or in place of encoders. For example, an optical positioning system, including one or more sensors and/or reflectors located on the base, frame or on the array itself, and an accompanying light source may be provided. In other embodiments, inclinometers and/or an inertial navigation unit (INU) located within the antenna array may be provided for monitoring the angular position of the array. In one embodiment, a two-axis inclinometer 88 may be provided for measuring the real-time tilt angle of the array. It should also be understood that this inclinometer, and/or the motion controller may be calibrated (e.g. zeroed) to correct for unlevel ground. Additional sensors may be implemented into the system for more precise control of the array. As indicated above, alterations to array orientation or scanning path may be made in real-time, to correct for, for example, temperature or thermal effects, wind/weather loads, and other environmental conditions. Accordingly, sensors operative to detect these conditions may be fitted to the system and input into the motion controller for increasing the operational accuracy of the array.

Referring again to FIGS. 2A-B, this control system may be located on or within the system's base. Base 21 may further comprise a housing 33 for the storage of the radar electronics including an inertial navigation/movement unit (INU/IMU), and the control system set forth in FIG. 8. The INU/IMU may also be located at the center of the sensor/array, thus eliminating the inaccuracies associated with remote mounting in traditional arrangements. Housing 33 may further comprise an onboard power-supply and a compressor or hydraulic pump to supply any of the systems components (e.g. actuators) with pressurized fluids, air, or power. In this way, the system may be portable and capable of independent operation. Likewise, power and/or a pressurized air or fluid supply can be provided by outside sources, including those found on support vehicles typically used in mobile radar arrangements.

The above-described embodiments utilize a control system (FIG. 8) to set and control the drive paths via precise control of the system's actuators. However, alternate embodiments of the present invention may utilize, for example, mechanical or optical followers (i.e. tracks with cam followers or optical sensors). In one exemplary embodiment, one or more sets of tracks for either a mechanical or optical follower may be formed on a surface of the frame (for example, the panels comprising surfaces 63 or 73 in FIGS. 6 and 7). In this way, one set of tracks may be specifically configured to articulate the array in a first predetermined manner (e.g. scanning pattern), while another set of tracks may be configured to articulate the sensor in a second predetermined manner. Switching between sets of tracks allows for altering the scanning mode of the sensor with minimal downtime. Likewise, these panels may be removeably attached to the frame, such that the system may be quickly reconfigured with a substitute set of panels to achieve various scanning paths. Further, these arrangements reduce system complexity, along with cost, while increasing system reliability.

While this disclosure describes a limited number of frame and support arrangements, it is envisioned that numerous alternate configurations may be utilized between the sensor and the base to provide a similarly pivotal system. For example, spherical bearings, such as pedestal air bearings may be used for providing low friction operation, a high degree of articulation in all directions of the sensor, and a high load-carrying capacity. Further still, flexures, hinges, or bushings may all be used without departing from the scope of the present invention.

Systems according to the above-described embodiments provide improved sensor coverage compared to conventional systems, without resorting to traditional rotational movement, and the above-described drawbacks associated therewith. Further, both the elevation angle and the azimuth position of the sensor in the embodiments described herein are controlled by the same drive components. This is unlike traditional systems which employ separate systems, for example a set of at least three linear actuators to level the base, a linear actuator to control the elevation angle of the sensor, and a rotational drive mechanism to alter the azimuth orientation. In accordance with embodiments of the present invention, complexity, cost, and weight reductions may be realized over the prior art arrangements.

While embodiments of the present invention have generally been described in the context of radar systems having articulating antenna arrays, it should be understood that embodiments of the drive system may be applied more generally to articulating sensors or antenna systems without departing from the scope of the present invention.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A method of articulating a sensor supported by a sensor support frame movably mounted with respect to a base, comprising the steps of:

applying a first friction force on a first three-dimensional curved surface having a constant radius of the sensor support frame supporting the sensor with a first friction drive actuator for pivoting the sensor support frame about a first axis and a pivot point; and applying a second friction force on a second three-dimensional curved surface having a constant radius of the sensor support frame with a second friction drive actuator for pivoting the sensor support frame about a second axis and the pivot point, wherein the pivot point is defined at an intersection of the first axis and the second axis;

wherein pivoting the sensor support frame about the first and second axes provides the sensor with 360 degrees of azimuth revolution at a plurality of elevation angles with respect to the base.

2. The method of claim 1, further comprising the step of maintaining the sensor at a predetermined elevation angle while pivoting the sensor support frame about the first and second axes and the pivot point to alter an azimuth position of the sensor with the first and second friction drive actuators.

3. The method of claim 1, wherein the sensor support frame is pivoted about the first and second axes simultaneously.

4. The method of claim 1, wherein the sensor support frame comprises a generally spherical shape.

5. A method of articulating a sensor supported by a sensor support frame curved in three dimensions, each of a constant radius, movably mounted with respect to a base, comprising the steps of:

applying a friction force on a three-dimensional curved surface of the sensor support frame curved in three dimensions with a friction drive actuator for pivoting the sensor support frame about at least two axes and a pivot point defined at an intersection of at least two axes;

pivoting the sensor support frame about the pivot point to alter an azimuth position of the sensor with the friction drive actuator while maintaining the sensor at a predetermined elevation angle with respect to the base.

6. The method of claim 5, wherein the step of pivoting the sensor support frame about the pivot point includes pivoting the sensor support frame about the at least two axes for altering the elevation and azimuth angle of the sensor.

7. The method of claim 6, wherein the step of pivoting the sensor support frame about at least two axes includes simultaneously pivoting the sensor about the at least two axes.

8. The method of claim 5, wherein the step of pivoting the sensor support frame about the pivot point to alter an azimuth position of the sensor comprises pivoting the sensor support frame such that its azimuth position is changing with a constant angular velocity.

9. The method of claim 5, wherein the sensor comprises a radar antenna array.

10. A method of articulating a sensor supported by a sensor support frame curved in three dimensions, each of a constant radius, movably mounted with respect to a base, comprising the steps of:

applying a friction force on a three-dimensional curved surface of the sensor support frame with a friction drive actuator for pivoting the sensor support frame curved in three dimensions about at least two axes and a pivot point for altering an elevation and azimuth angle of the sensor, the pivot point defined at an intersection of the at least two axes; and applying a friction force on the three-dimensional curved surface of the sensor support frame with the friction drive actuator for pivoting the sensor support frame curved in three dimensions about the at least two axes and the pivot point for altering an azimuth angle of the sensor while maintaining the sensor at a predetermined elevation angle with respect to the base.

11. The method of claim 10, wherein the sensor support frame comprises a generally spherical shape.

12. The method of claim 10, wherein the friction drive actuator is configured to provide the sensor with 360 degrees of azimuth revolution at a plurality of elevation angles.

* * * * *